US011027169B2

(12) United States Patent
Xing

(10) Patent No.: US 11,027,169 B2
(45) Date of Patent: Jun. 8, 2021

(54) ELECTRIC TREADMILL

(71) Applicant: OMA FITNESS EQUIPMENT CO., LTD., Foshan (CN)

(72) Inventor: Kaibin Xing, Foshan (CN)

(73) Assignee: OMA FITNESS EQUIPMENT CO., LTD., Foshan (CN)

( * ) Notice: Subject to any disclaimer, the term of this patent is extended or adjusted under 35 U.S.C. 154(b) by 0 days.

(21) Appl. No.: 16/367,584

(22) Filed: Mar. 28, 2019

(65) Prior Publication Data

US 2020/0215380 A1 Jul. 9, 2020

(30) Foreign Application Priority Data

Jan. 9, 2019 (CN) ..... 201910020275.4

(51) Int. Cl.
*A63B 22/02* (2006.01)
*A63B 22/00* (2006.01)

(52) U.S. Cl.
CPC ..... *A63B 22/025* (2015.10); *A63B 22/0046* (2013.01); *A63B 22/0257* (2013.01)

(58) Field of Classification Search
CPC ..... A63B 22/025; A63B 22/0046; A63B 22/0257; A63B 22/0214; A63B 22/0221; A63B 22/0285; A63B 22/02; A63B 22/0278; A63B 22/0292; A63B 22/0207; A63B 22/0228; A63B 22/0235;
(Continued)

(56) References Cited

U.S. PATENT DOCUMENTS 2,178,271 A * 10/1939 Soss ..... E05D 3/186 16/358
2,608,713 A * 9/1952 Soss ..... E05D 3/186 16/337

(Continued)

FOREIGN PATENT DOCUMENTS

CN 2368551 3/2000
CN 2368551 Y * 3/2000

(Continued)

OTHER PUBLICATIONS

International Search Report (w/ English Translation) for corresponding Chinese Application No. 2019100202754, dated Mar. 20, 2020, 5 pages.

(Continued)

*Primary Examiner* — Gary D Urbiel Goldner
*Assistant Examiner* — Thao N Do
(74) *Attorney, Agent, or Firm* — Dority & Manning, P.A.

(57) ABSTRACT

The present disclosure proposes an electric treadmill. The electric treadmill includes a base and an armrest. The base includes a front frame, a rear frame and a connecting assembly, wherein tread boards are provided within the front frame and the rear frame, and the front frame and the rear frame are hinged by the connecting assembly to enable the base to be folded. The armrest includes a vertical tube and a cross tube, wherein one end of the vertical tube is connected to the cross tube and the other end of the vertical tube is rotatably coupled to the base to allow the armrest to be foldable with respect to the base. The front frame and the rear frame may be folded with respect to each other, thus, a length of the base is greatly reduced for storage.

11 Claims, 9 Drawing Sheets

(58) Field of Classification Search
CPC ..... A63B 22/0242; A63B 22/0264; A63B 71/0619; A63B 2022/0278; A63B 2022/0271; A63B 2022/0264; A63B 2022/0257; A63B 2210/00; A63B 2210/50; A63B 2210/58
USPC ..... 482/54
See application file for complete search history.

(56) References Cited

U.S. PATENT DOCUMENTS 3,001,224 A * 9/1961 Soss ..... E05D 3/16 16/276
4,842,266 A * 6/1989 Sweeney, Sr. ..... A63B 22/02 482/54
5,336,146 A * 8/1994 Piaget ..... A63B 22/0056 482/51
5,419,747 A * 5/1995 Piaget ..... A63B 22/001 434/255
5,971,891 A * 10/1999 Humphrey ..... A63B 69/0022 482/51
6,068,579 A * 5/2000 Killian ..... A63B 22/0023 482/51
6,527,678 B1 * 3/2003 Wang ..... A63B 22/0235 482/51
7,004,887 B2 * 2/2006 Pan ..... A63B 22/02 482/54
7,141,006 B1 * 11/2006 Chen ..... A63B 22/02 482/54
7,789,807 B1 * 9/2010 Wang ..... A63B 22/0235 482/54
8,650,713 B2 * 2/2014 Migliorini ..... E05D 11/1021 16/302
8,926,479 B2 * 1/2015 Chen ..... A63B 22/02 482/54
9,474,928 B1 * 10/2016 Maresh ..... A63B 22/02
9,480,874 B2 * 11/2016 Cutler ..... A63B 22/0046
10,589,147 B1 * 3/2020 Kostadis ..... A63B 22/0235
2002/0103057 A1 * 8/2002 Watterson ..... A63B 22/0023 482/54
2003/0060331 A1 * 3/2003 Polk, III ..... A63B 22/0235 482/20
2004/0214693 A1 * 10/2004 Piaget ..... A63B 22/0235 482/52
2004/0242379 A1 * 12/2004 Juva ..... A63B 22/02 482/54
2006/0009332 A1 * 1/2006 Jones ..... A61H 1/0255 482/54
2007/0037667 A1 * 2/2007 Gordon ..... A63B 22/0056 482/51
2008/0188358 A1 * 8/2008 Kuo ..... A63B 22/0235 482/54
2008/0234111 A1 * 9/2008 Packham ..... A63B 22/02 482/54
2009/0062072 A1 3/2009 Packham
2009/0163326 A1 * 6/2009 Wang ..... A63B 22/02 482/54
2009/0176627 A1 * 7/2009 Wang ..... A63B 22/0235 482/54
2009/0181830 A1 * 7/2009 Wu ..... A63B 22/001 482/54
2009/0239716 A1 * 9/2009 Wang ..... A63B 22/0235 482/54
2010/0048360 A1 * 2/2010 Wang ..... A63B 22/0235 482/54
2011/0021323 A1 * 1/2011 Wu ..... A63B 22/0235 482/54
2012/0165161 A1 * 6/2012 Chen ..... A63B 22/02 482/54
2012/0283070 A1 * 11/2012 Lai ..... A63B 22/02 482/54
2013/0092096 A1 * 4/2013 Rosenberg ..... A01K 15/027 119/703
2013/0231216 A1 * 9/2013 Hao ..... A47B 37/00 482/4
2015/0051051 A1 * 2/2015 Liu ..... A63B 22/02 482/54
2015/0209610 A1 * 7/2015 Dalebout ..... A63B 21/0051 482/54
2015/0209618 A1 * 7/2015 Li ..... A63B 22/0228 482/7
2015/0251048 A1 * 9/2015 Dalebout ..... A63B 71/0686 482/54
2016/0001119 A1 * 1/2016 Jue ..... A63B 22/02 482/54
2016/0096064 A1 4/2016 Gatti
2016/0263417 A1 * 9/2016 Golesh ..... A63B 21/00069
2017/0095688 A1 * 4/2017 Stilson ..... A63B 21/0728
2017/0136288 A1 * 5/2017 Huang ..... A63B 22/02
2019/0201739 A1 * 7/2019 Johnson ..... A63B 1/00
2019/0247708 A1 * 8/2019 Jin ..... A63B 22/0285
2019/0247709 A1 * 8/2019 Jin ..... A63B 22/0207
2019/0290956 A1 * 9/2019 Ren ..... A63B 22/0235
2020/0171346 A1 * 6/2020 Chen ..... A63B 22/205

FOREIGN PATENT DOCUMENTS

CN 2813000 Y * 9/2006
CN 2813000 Y * 9/2006
CN 201486318 5/2010
CN 205019639 2/2016
CN 206518814 9/2017
CN 107349562 11/2017
CN 107349562 A * 11/2017
CN 108295424 * 3/2018
CN 207130884 U 3/2018
CN 207323940 5/2018
CN 207323940 U * 5/2018
CN 108295424 A * 7/2018 ..... A63B 71/023
CN 108295424 A * 7/2018 ..... A63B 71/023
CN 207769063 8/2018
CN 210409369 U * 3/2019
CN 208943362 U * 6/2019
CN 110180131 A * 8/2019
CN 209900574 U * 1/2020
JP H11128390 5/1999
JP 2007268146 10/2007
TW M412784 10/2011
WO WO 2007/061317 5/2007
WO WO 2018/236945 12/2018

OTHER PUBLICATIONS

First Office Action for corresponding Chinese Application No. 2019100202754, dated Mar. 30, 2020—8 pages.
JP Office Action (w/ English translation) for corresponding Japanese Patent Application No. 2019-103882, dated Jul. 30, 2020—12 pages.
JP Office Action (w/ English translation) for corresponding Japanese Patent Application No. 2019-103882, dated Feb. 24, 2021—10 pages.
Chinese Second Office Action (w/ English translation) for corresponding CN Application No. 2019100202754, dated Dec. 7, 2020, 8 pages.
Chinese Supplementary Search Report (w/ English translation) for corresponding CN Application No. 2019100202754, dated Nov. 27, 2020, 4 pages.

* cited by examiner

ELECTRIC TREADMILL

CROSS REFERENCE TO RELATED APPLICATIONS

The present application claims the benefit of priority to Chinese patent application No. 201910020275.4, filed on Jan. 9, 2019, entitled "Electric Treadmill", the disclosure of which is hereby incorporated by reference in its entirety.

TECHNICAL FIELD

The disclosure relates to the technical field of fitness instrument, in particular to an electric treadmill.

BACKGROUND

The treadmill is common fitness equipment used at home and gyms, which is the simple one and the optimization of household fitness instruments. The treadmill includes a base supporting a user to run or walk thereon, and an armrest equipped with various electronic components to control the treadmill and to provide interactions.

In order to provide a good running experience, a length of the base needs to be larger than a stride length of the user. Usually the length of the base ranges from 1.5 to 2 meters. However, the longer the length of the base, the wider a width of the base. Therefore, the treadmill may take up more spaces.

SUMMARY

Embodiments of the present disclosure provide an electric treadmill to solve or alleviate one or more technical problems in the prior art, or at least provide an advantageous selection.

In order to achieve the above object, in one aspect of the present disclosure, an embodiment of the present disclosure provides an electric treadmill, which includes:

a base including a front frame, a rear frame and a connecting assembly, wherein tread boards are provided within the front frame and the rear frame, and the front frame and the rear frame are hinged together by the connecting assembly to enable the base to be folded;

an armrest including a vertical tube and a cross tube, wherein one end of the vertical tube is connected to the cross tube, and the other end of the vertical tube is rotatably coupled to the base to fold the armrest with respect to the base.

In an embodiment, the connecting assembly includes a first connecting member, a second connecting member, two third connecting members, and a fourth connecting member, wherein one end of the first connecting member is connected to the front frame and the other end of the first connecting member is hinged with one end of each third connecting member; a middle portion of the second connecting member is hinged with a middle portion of each third connecting member; and one end of the fourth connecting member is hinged with one end of the second connecting member, and the other end of the fourth connecting member is connected to the rear frame.

In an embodiment, the first connecting member includes a head portion and a bottom portion; the head portion protrudes from an intermediate position of the bottom portion to form a a T shaped first connecting member; a first through hole is provided at one end of the bottom portion away from the head portion, to hinge the first connecting member with the base; a second through hole is provided at the head portion to hinge the first connecting member with each third connecting member, and a side of the bottom portion facing the second connecting member is provided with a first curved slot;

wherein the second connecting member includes a front portion and a rear portion disposed at a predetermined angle with the front portion, one end of the front portion away from the rear portion is provided with a first curved surface corresponding to the first curved slot, a middle portion of the second connecting member is hinged with a middle portion of each third connecting member, and one end of the rear portion away from the front portion is hinged with the one end of the fourth connecting member;

wherein the one end of each third connecting member is hinged with the head portion, the other end of each third connecting member is provided with an arcuate protrusion facing the fourth connecting member; and wherein the one end of the fourth connecting member is hinged with the rear portion, the other end of the fourth connecting member is hinged with the rear frame, and the fourth connecting member further is provided with a second curved surface facing the third connecting members, and the second curved surface is fitted to the arcuate protrusion.

In an embodiment, the connecting assembly includes a front mount, a rear mount, a first hinge tooter, a second hinge tooth, a third hinge tooth and a fourth hinge tooth; the first hinge tooth, the second hinge tooth, the third hinge tooth, and the fourth hinge tooth are all L-shaped with a short portion and a long portion; the front mount is fastened to the front frame and the rear mount is fastened to the rear frame; a joint between the short portion and the long portion of the first hinge tooth, a joint between the short portion and the long portion of the second hinge tooth, a joint of the short portion and the long portion of the third hinge tooth, and a joint between the short portion and the long portion of the fourth hinge tooth are hinged together by a first rotating shaft; front ends of the long portions of the first hinge tooth and the second hinge tooth are hinged together by a second rotating shaft; rear ends of the long portions of the third hinge tooth and the fourth hinge tooth are hinged together by a third rotating shaft; the third hinge tooth is disposed between the first hinge tooth and the second hinge tooth, and the second hinge tooth is disposed between the third hinge tooth and the fourth hinge tooth; and wherein the front mount is provided with a front relief groove for accommodating the first hinge tooth and the second hinge tooth, and a front chute extending in a front-rear direction; the rear mount is provided with a rear relief groove for accommodating the third hinge tooth and the fourth hinge tooth, and a rear chute extending in the front-rear direction; the second rotating shaft is slidably coupled to the front chute, and the third rotating shaft is slidably coupled to the rear chute.

In an embodiment, the vertical tube includes a hollow tube, an armrest tube, and a controllable gas spring, wherein the armrest tube is disposed in the hollow tube, one end of the controllable gas spring is connected to the armrest tube, and the other end of the controllable gas spring is connected to the hollow tube, and the armrest tube is telescoped relative to the hollow tube to adjust a length of the armrest.

In an embodiment, the electric treadmill further includes a side rest detachably connected with the armrest, and a connecting portion provided on the armrest tube, corresponding to the side rest; wherein the side rest comprises a main body; a tab is provided at an end of the main body; a slot is provided on the connecting portion; and the tab is inserted into the slot to connect the main body to the connecting portion.

In an embodiment, the electric treadmill further includes a spring provided at the end of the main body, and a ball connected to the spring; wherein the ball is abutted against the connecting portion by a force of the spring.

In an embodiment, the electric treadmill further includes a locking assembly, wherein the locking assembly includes a quick release lever, a pressing block, a positioning sleeve, a spring, and a spacer; the positioning sleeve is disposed at the joint between the hollow tube and the armrest tube; the quick release lever is hinged with the positioning sleeve, and the pressing block is disposed between the quick release lever and the positioning sleeve; and one end of the quick release lever connected to the positioning sleeve is provided with a cam structure so as to press the quick release lever against the pressing block to lock the armrest tube.

In an embodiment, the electric treadmill further includes a depressurizing lever, wherein one end of the depressurizing lever is connected to the armrest, and the other end of the depressurizing lever is connected to the base to slow down a speed of the armrest rotating toward the base.

In an embodiment, one end of the depressurizing lever is connected to the hollow tube, and the other end of the depressurizing lever is connected to the front frame, both ends of which are fastened by bolts and fasteners.

In an embodiment, the electric treadmill further includes a torsional spring, wherein one end of the torsional spring is connected to the vertical tube, and the other end of the torsional spring is connected to the front frame, to slow down a rotating speed of the vertical tube toward the front frame.

In an embodiment, an angle retaining plate, a stopper plate and a locking handle are provided at a joint between the vertical tube and the base, the angle retaining plate is provided with a curved retaining slot, and a retaining shaft corresponding to the curved retaining slot is provided at the base to cooperate with the angle retaining plate, so as to limit a rotating angle of the armrest, and wherein one end of the locking handle is provided with a cam structure so that the locking handle enables to limit a rotation of the vertical tube relative to the base, and the armrest is foldable over the base by pulling the locking handle and rotating the armrest for storage.

In an embodiment, an angle between the front frame and the rear frame varies between 0 and 180 degrees, the tread board comprises a front tread board and a rear tread board, the front tread board is provided in the front frame and the rear tread board is provided in the rear frame; and the front tread board and the rear tread board are combined to support the user in case of the angle between the front frame and the rear frame being 180 degrees.

In an embodiment, the armrest comprises a plurality of vertical tubes disposed on two sides of the front frame respectively, the vertical tubes are connected with the cross tube to form a storage space for accommodating the base, and the front frame and the rear frame is accommodated in the storage space in case of the angle between the front frame and the rear frame being 0 degree.

Some of the above technical solutions have the following advantages or beneficial effects. The front frame and the rear frame in the present disclosure may be folded with respect to each other, thus, reducing a length of the base for storage and improving the experience of users.

The above summary is for the purpose of illustration only and is not intended to limit. Additionally to the illustrative aspects, embodiments and features described above, further aspects, embodiments and features of the present disclosure will be readily apparent by reference to the accompanying claims.

BRIEF DESCRIPTION OF THE DRAWINGS

In the drawings, the same reference numerals denote the same or similar parts or elements throughout unless otherwise specified. The drawings are not necessary drawn to scale. It should be understood that these drawings depict only some embodiments disclosed in accordance with present disclosure and should not be construed as limiting the scope of present disclosure.

DETAILED DESCRIPTION OF EMBODIMENTS

In the following, only certain embodiments are briefly described. As can be recognized by those skilled in the art, various modifications can be made to the described embodiments without departing from the spirit or scope of present disclosure. Therefore, the drawings and the description are substantially regarded as exemplary rather than restrictive.

The present disclosure provides an electric treadmill.

Figure 1:
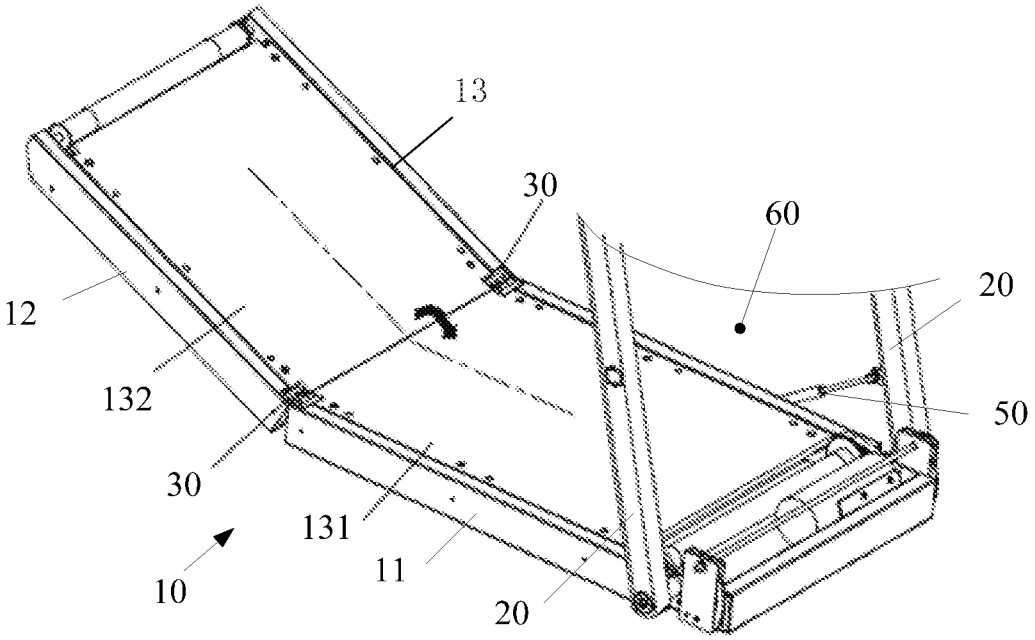
FIG. 1 is a schematic view of a partial structure of a treadmill according to an embodiment of the present disclosure.
Figure 2:
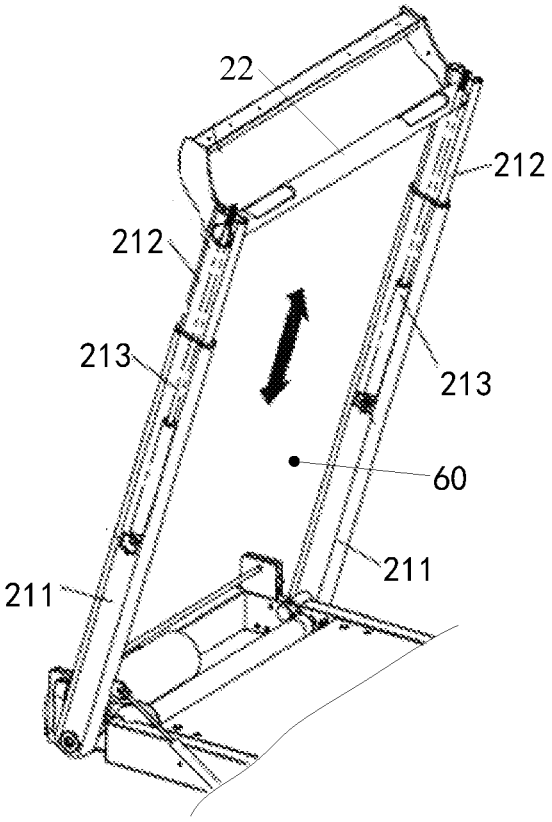
FIG. 2 is a schematic view of a partial structure of a treadmill according to another embodiment of the present disclosure.
Figure 3:
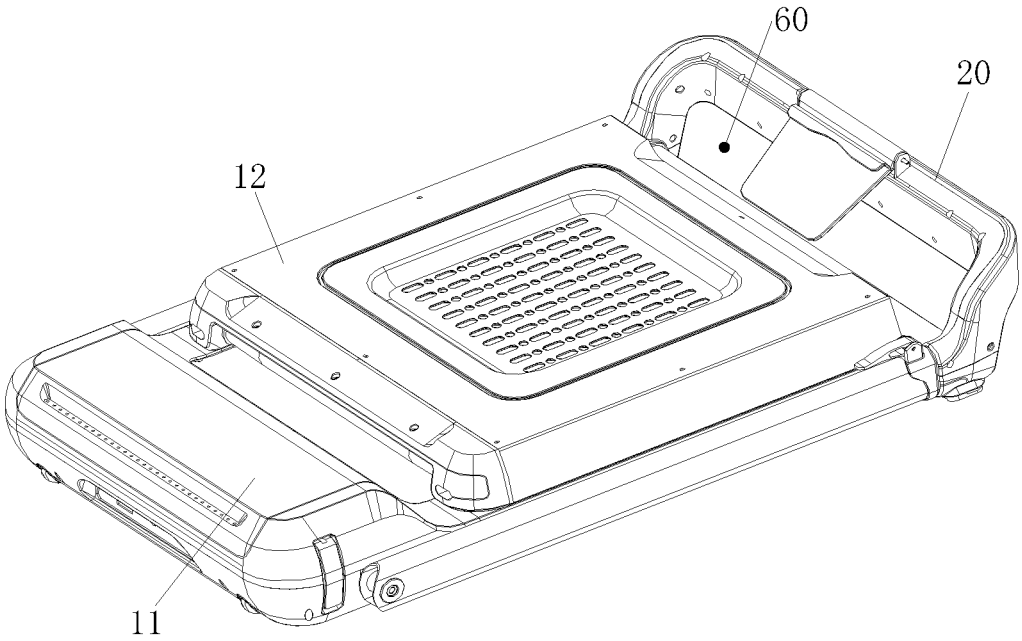
FIG. 3 is a schematic view of a treadmill in a collapsed state according to another embodiment of the present disclosure.
Figure 4:
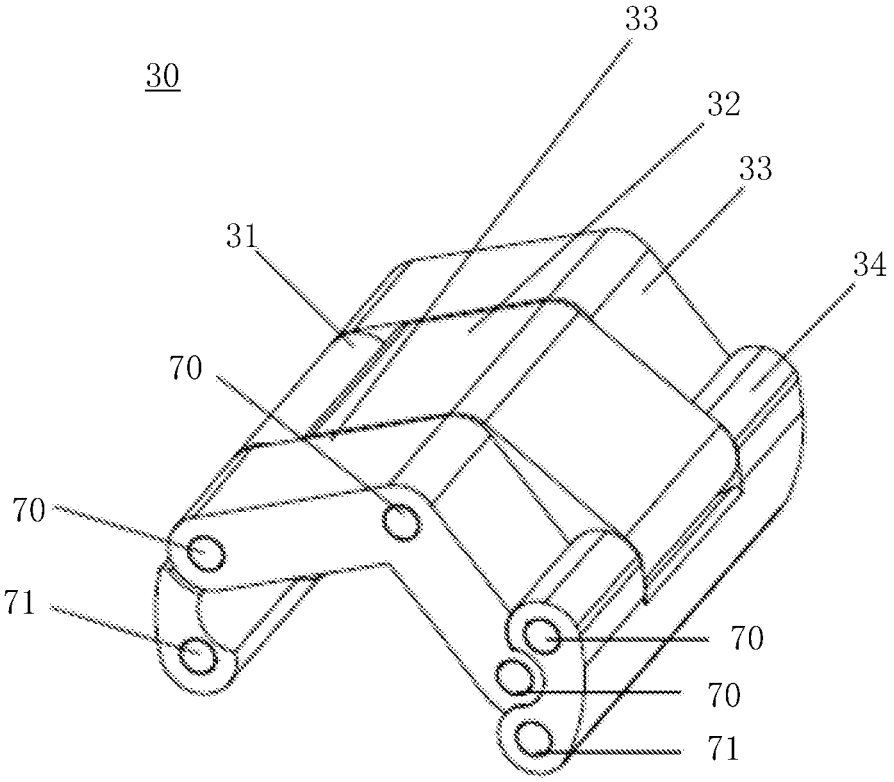
FIG. 4 is a schematic view of a connecting assembly according to another embodiment of the present disclosure.
Figure 5:
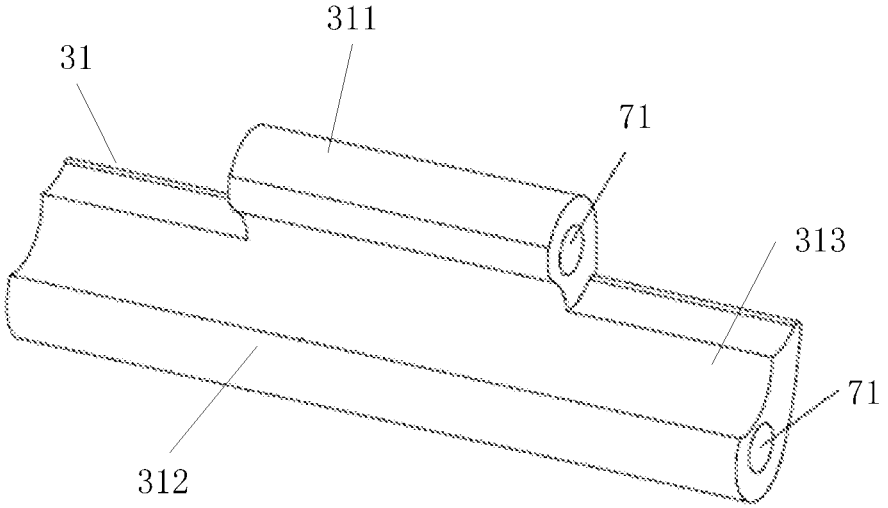
FIG. 5 is a schematic view of a first connecting member according to another embodiment of the present disclosure.
Figure 6:
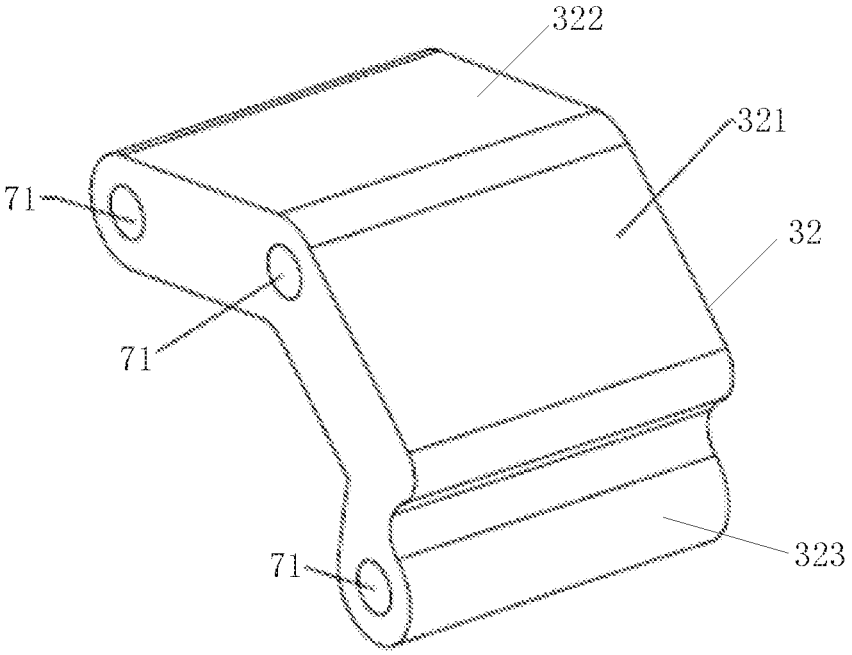
FIG. 6 is a schematic view of a second connecting member according to another embodiment of the present disclosure.
Figure 7:
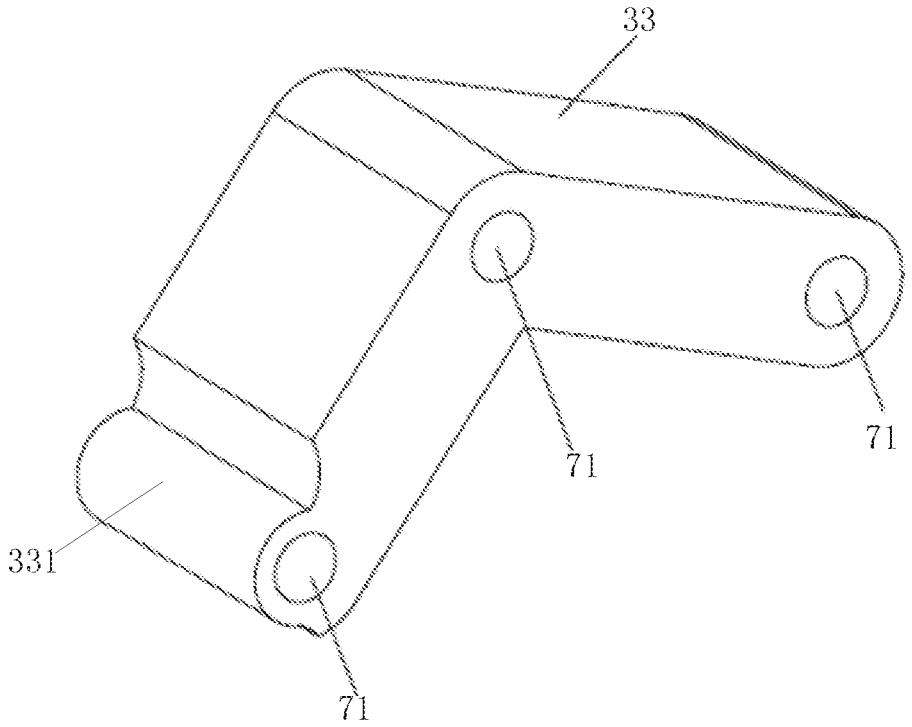
FIG. 7 is a schematic view of a third connecting member according to another embodiment of the present disclosure.
Figure 8:
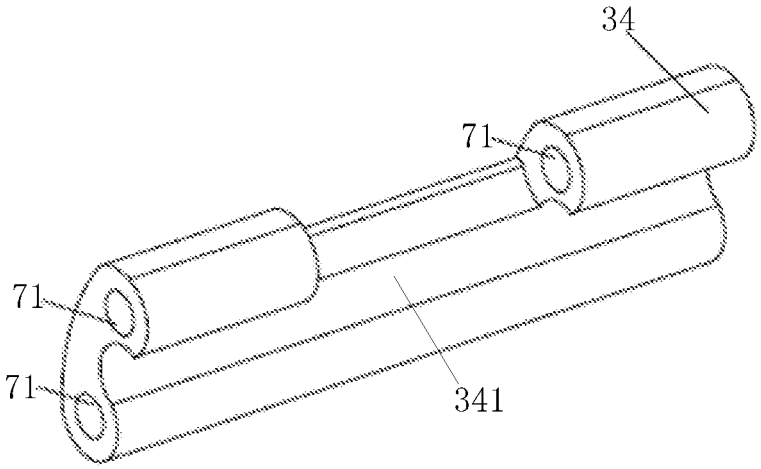
FIG. 8 is a schematic view of a fourth connecting member according to another embodiment of the present disclosure.

Referring to FIGS. 1-3, the electric treadmill includes a base 10 and an armrest 20. The base 10 is provided with a drive motor, a drum, a running belt and other components, while the armrest 20 is provided with an operation switch and other control components.

The base 10 presents a shape of a rectangular plate, and includes a front frame 11, a rear frame 12, and a connecting assembly 30, wherein tread boards 13 are provided within the front frame 11 and the rear frame 12. The front frame 11 and the rear frame 12 are hinged together by the connecting assembly 30 in order to fold the base 10 for storage. The connection between the front frame 11 and the rear frame 12 is not limited thereto, and the connection capable of folding and accommodating the base 10 may be applied thereto.

The armrest 20 includes a vertical tube 21 and a cross tube 22. One end of the vertical tube 21 is connected to the cross tube 22, and the other end of the vertical tube 21 is rotatably coupled to the base 10 to allow the armrest 20 to be folded with respect to the base 10. As shown in FIG. 3, the front frame 11 and the rear frame 12 may be foldable with respect to each other. The armrest 20 and the base 10 may also be foldable with respect to each other. A length of the base 10 is greatly reduced for storage, thus, improving the experience of users.

Referring to FIGS. 4-8 in an embodiment, the connecting assembly 30 includes a first connecting member 31, a second connecting member 32, two third connecting members 33, and a fourth connecting member 34, wherein the second connecting member 32 is disposed between the two third connecting members 33. One end of the first connecting member 31 is hinged with the front frame 11, and the other end of the first connecting member 31 is hinged with one end of each third connecting member 33. The middle portion of the second connecting member 32 is hinged with the middle portion of each third connecting members 33. One end of the fourth connecting member 34 is hinged with one end of each second connecting member 32, and the other end of the fourth connecting member 34 is hinged with the rear frame 12.

Further, the first connecting member 31 includes a head portion 311 and a bottom portion 312. The head portion 311 protrudes from an intermediate position of the bottom portion 312 to form a T shaped first connecting member 31. A first through hole 71 is provided at one end of the bottom portion 312 away from the head portion 311, to hinge the first connecting member 31 with the base 10 by a rotating shaft 70. A second through hole 71 is provided at head portion 311 to hinge the first connecting member 31 with the third connecting members 33. A side of the bottom portion 312 facing the second connecting member 32 is provided with a first curved slot 313.

The second connecting member 32 includes a front portion 321; and a rear portion 322 disposed at a predetermined angle with the front portion 321. One end of the front portion 321 away from the rear portion 322 is provided with a first curved surface 323 corresponding to the first curved slot 313. The middle portion of the second connecting member 32, that is, a joint between the front portion 321 and the rear portion 322, is hinged with the middle portion of each third connecting member 33. One end of the rear portion 322 away from the front portion 321 is hinged with the one end of the fourth connecting member 34.

One end of each third connecting member 33 is hinged with the head portion 311, and the other end of each third connecting members 33 is provided with an arcuate protrusion 331 facing the fourth connecting member 34.

One end of the fourth connecting member 34 is hinged with the rear portion 322, and the other end of the fourth connecting member 34 is hinged with the rear frame 12. A second curved surface 341 facing the third connecting members 33 is provided with on the fourth connecting member 34, wherein the second curved surface 341 is fitted to the arcuate protrusion 331.

When the front frame and the rear frame are in a folded state, that is, the front frame and the rear frame are at an angle of 0 degree as shown in FIG. 3, the first curved surface 323 abuts the first curved slot 313 and the arcuate protrusion 331 abuts the second curved surface 341. When the front frame and the rear frame are in an unfolded state, that is, the front frame and the rear frame are at an angle of 180 degrees, the rear frame rotates relative to the front frame to separate the first curved surface 323 from the first curved slot 313, and separate the circular arcuate protrusion 331 from the second curved surface 341.

Figure 9:
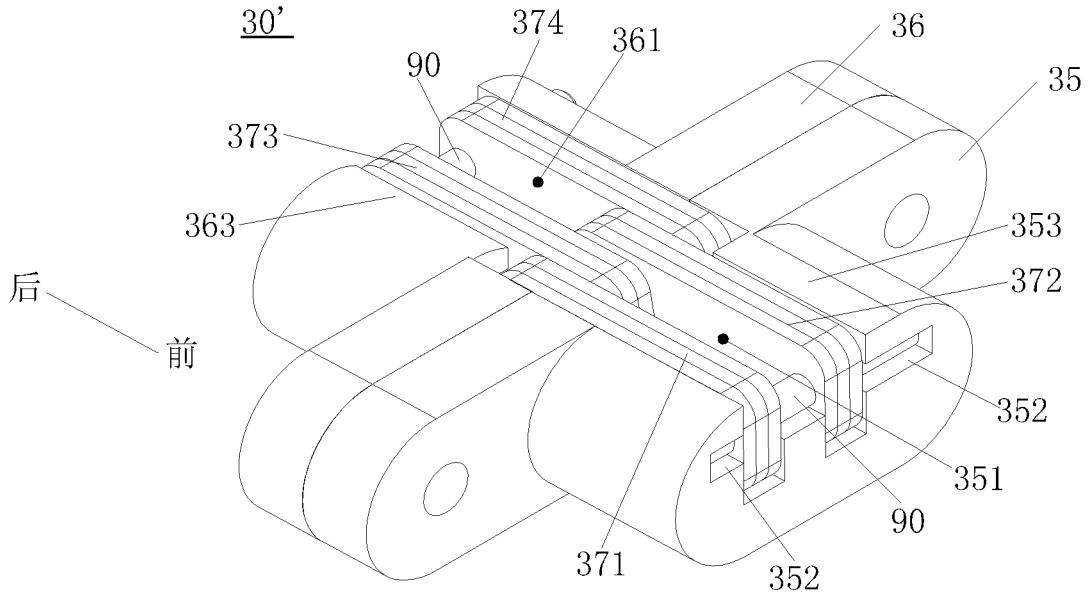
FIG. 9 is a schematic view of a connecting assembly in a folded state according to another embodiment of the present disclosure.
Figure 10:
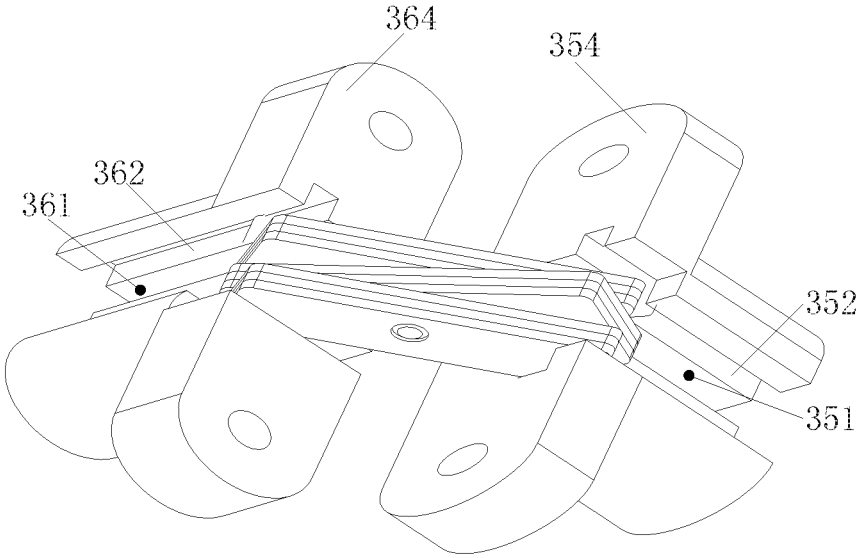
FIG. 10 is a schematic view of a connecting assembly in an enfolded state according to another embodiment of the present disclosure.
Figure 11:
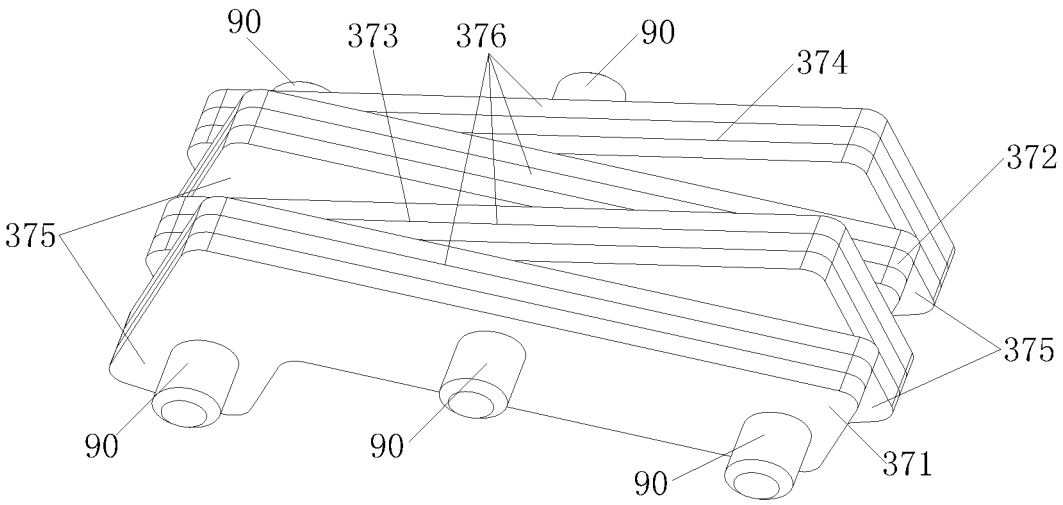
FIG. 11 is a schematic view of a partial structure of a connecting assembly according to another embodiment of the present disclosure.

Referring to FIGS. 9-11, another connecting assembly 30' is provided in another embodiment. The connecting assembly 30' includes a front mount 35, a rear mount 36, a first hinge tooth 371, a second hinge tooth 372, a third hinge tooth 373, a fourth hinge tooth 374, and a rotating shaft 90. The first hinge tooth 371, the second hinge tooth 372, the third hinge tooth 373, and the fourth hinge tooth 374 are all L-shaped with a short portion 375 and a long portion 376. A joint between the short portion 375 and the long portion 376 of the first hinge tooth 371, a joint between the short portion 375 and the long portion 376 of the second hinge tooth 372, a joint between the short portion 375 and the long portion 376 of the third hinge tooth 373 and a joint between the short portion 375 and the long portion 376 of the fourth hinge tooth 374 are hinged together by a first rotating shaft 90. Front ends of the long portions 376 of the first hinge tooth 371 and the second hinge tooth 372 are hinged together by a second rotating shaft 90. Rear ends of the long portions 376 of the third hinge tooth 373 and the fourth hinge tooth 374 are hinged together by a third rotating shaft 90. The third hinge tooth 373 is disposed between the first hinge tooth 371 and the second hinge tooth 372, and the second hinge tooth 372 is disposed between the third hinge tooth 373 and the fourth hinge tooth 374.

The front mount 35 is provided with a front relief groove 351 for accommodating the first hinge tooth 371 and the second hinge tooth 372. Also, the front mount 35 is also provided with a front chute 352 extending in a front-rear direction. The rear mount 36 is provided with a rear relief groove 361 for accommodating the third hinge tooth 373 and the fourth hinge tooth 374. Also, the rear mount 36 is also provided with a rear chute 362 extending in the front-rear direction. The second rotating shaft 90 is slidably coupled to the front chute 352. The third rotating shaft 90 is slidably coupled to the rear chute 362.

when the front mount 35 and the rear mount 36 are unfolded, that is, a front abutting surface 354 of the front mount 35 and a rear abutting surface 364 of the rear mount 36 changes from a state of being in contact with each other to a state of being at 180 degrees therebetween, the front abutting surface 354 and the rear abutting surface 364 form an angle with respect to each other. The first hinge tooth 371, the second hinge tooth 372, the third hinge tooth 373 and the fourth hinge tooth 374 rotate around the first rotating shaft 90, so that the second rotating shaft 90 may slide in the front chute 352 from front to rear, and the third rotating shaft 90 may slide in the rear chute 362 from rear to front. As the rotating around the first rotating shaft 90 and the sliding of the second and third rotating shaft 90, the front mount 35 and the rear mount 36 may be completely unfolded. At this time, the second rotating shaft 90 remains at the rear end of the front chute 352, and the third rotating shaft 90 remains at the front end of the rear chute 362.

when the front mount 35 and the rear mount 36 are folded, that is, the front abutting surface 354 and the rear abutting surface 364 changes from the state of being at 180 degrees to the state of being in contact with each other, the rear frame 12 rotates relative to the front frame 11. The rear mount 36 pushes the third rotating shaft 90 such that the second rotating shaft 90 may slide in the front chute 352 from rear to front. The front mount 35 pushes the second rotating shaft 90, so that the second rotating shaft 90 may slide in the rear chute 362 from front to rear. As the rotating around the first rotating shaft 90 and the sliding of the second and third rotating shaft 90, the front mount 35 and the rear mount 36 may be completely folded. Thus, the front abutting surface 354 and the rear abutting surface 364 are in contact with each other.

Referring to FIG. 2, in an embodiment, the vertical tube 21 includes a hollow tube 211, an armrest tube 212, and a controllable gas spring 213. The armrest tube 212 is disposed in the hollow tube 211. One end of the controllable gas spring 213 is connected to the armrest tube 212 and the other end of the controllable gas spring 213 is connected to the hollow tube 211. The armrest tube 212 may be telescoped relative to the hollow tube 211 to adjust a length of the armrest 20.

Figure 12:
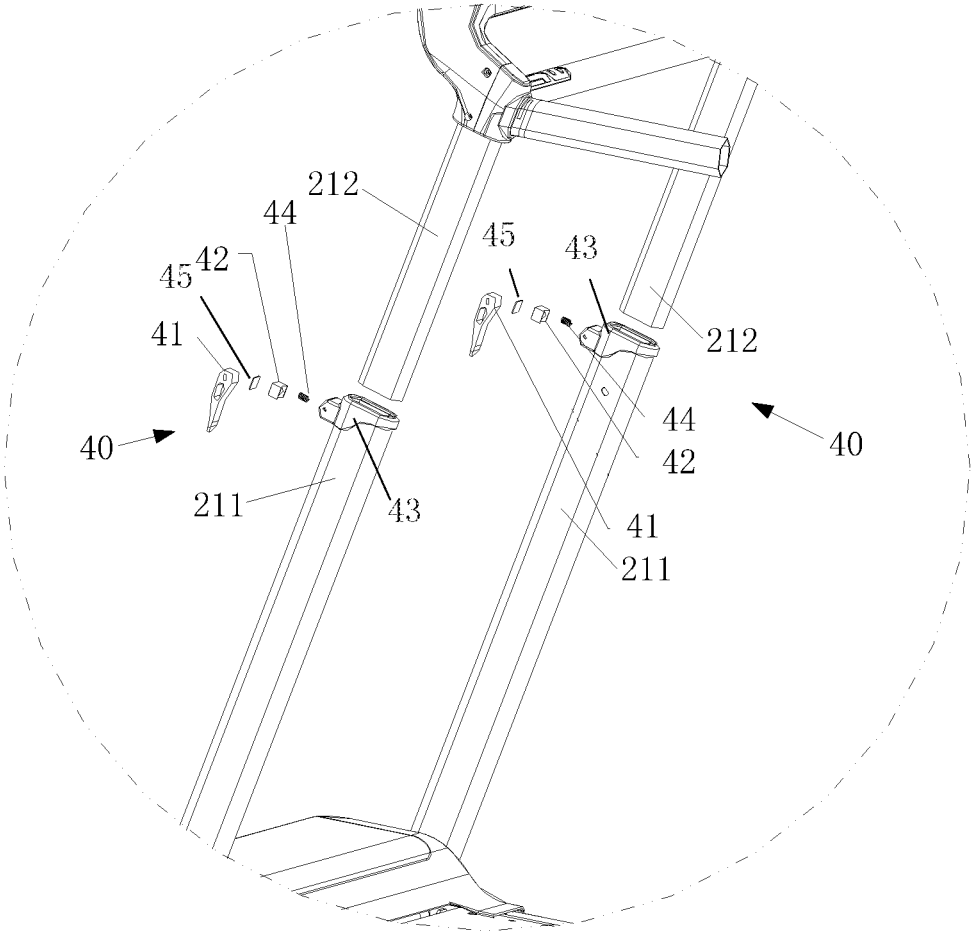
FIG. 12 is a schematic view of a locking assembly according to another embodiment of the present disclosure.

As shown in FIG. 12, in an embodiment, the electric treadmill further includes a locking assembly 40 for locking and fastening the armrest tube 212, which specifically includes a quick release lever 41, a pressing block 42, a positioning sleeve 43, a spring 44 and the spacer 45. The positioning sleeve 43 is disposed at the joint between the hollow tube 211 and the armrest tube 212. The quick release lever 41 is hinged with the positioning sleeve 43, and the pressing block 42 is disposed between the quick release lever 41 and the positioning sleeve 43. Meanwhile, a cam structure is provided at one end of the quick release lever 41 connected to the positioning sleeve 43, so as to press the quick release lever 41 against the pressing block 42 to lock the armrest tube 212.

Figure 16:
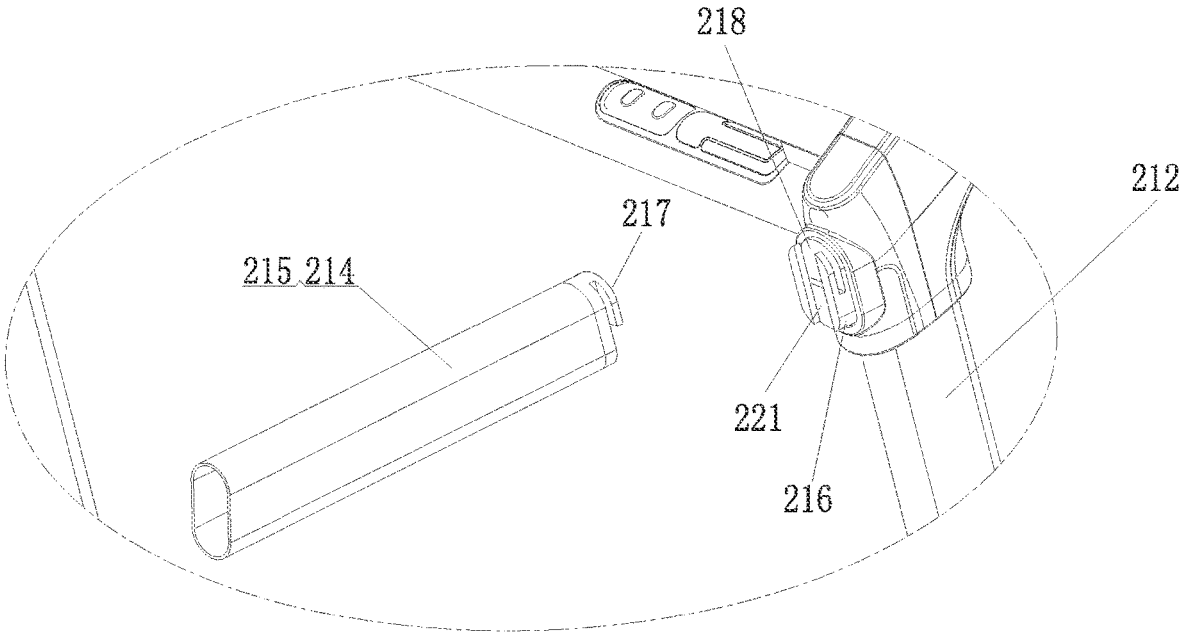
FIG. 16 is a schematic view showing an armrest tube connecting with a side rest according to another embodiment of the present disclosure.
Figure 17:
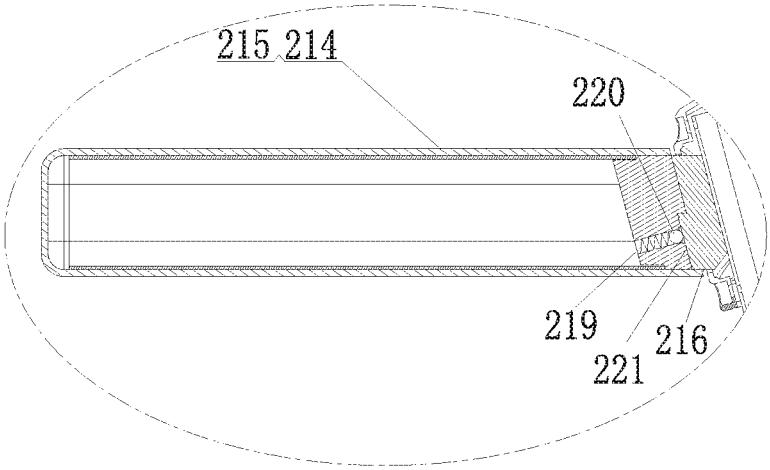
FIG. 17 is a sectional view showing an armrest tube connecting with a side rest according to another embodiment of the present disclosure.

Referring to FIGS. 16 and 17, in an embodiment, a side rest 214 is detachably is connected to the armrest tube 212. A connecting portion 216 corresponding to the side rest 214 is provided on the armrest tube 212. The side rest 214 includes a main body 215 with a tab 217 at an end. A slot 218 is provided on the connecting portion 216. Referring to FIG. 16, the tab 217 may slide along a direction from up to down and insert into the slot 218, so that the main body 215 may be connected to the connecting portion 216.

Further, combining with FIG. 17, a spring 219 is provided at the end of main body 215. One end of the spring 219 is connected to the main body 215, and a ball 220 is provided at the other end of the spring 219. As the tab 217 is inserted into the slot 218 along the direction from up to down, the ball 220 may contact a surface 221 of the connecting portion 216. Thus, the surface 221 may apply a force to ball 220 so as to compress the spring 219. Meanwhile, the spring 219 may react a force on the ball 220 and the surface 221 to abut the ball 220 against the surface 221, thus fastening the tab 217 into the slot 218.

Figure 13:
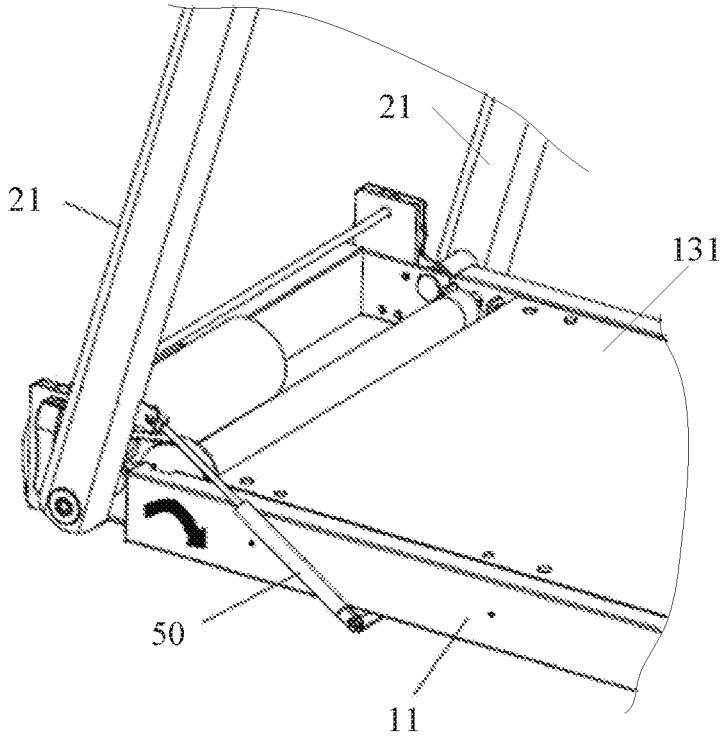
FIG. 13 is a schematic view of a partial structure of a treadmill according to another embodiment of the present disclosure.

Referring to FIG. 13, in an embodiment, the electric treadmill further includes a depressurizing lever 50. One end of the depressurizing lever 50 is connected to the armrest 20, and the other end of the depressurizing lever 50 is connected to the base 10, so as to slow down a speed of the armrest 20 rotating toward the base 10.

Further, one end of the depressurizing lever 50 is connected to the hollow tube 211, and the other end of the depressurizing lever 50 is connected to the front frame 11. Both ends of the depressurizing lever are fastened by bolts and fasteners.

Figure 15:
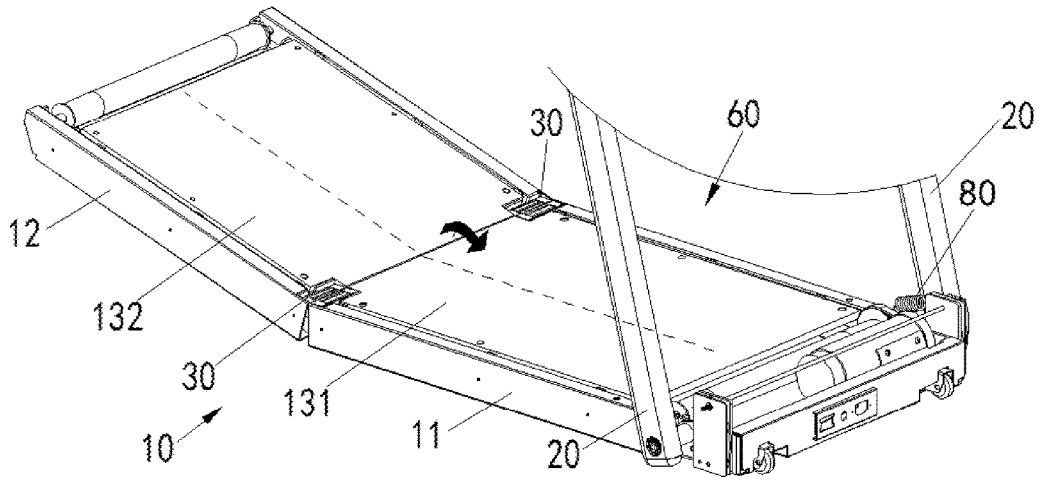
FIG. 15 is a schematic view of a partial structure of a treadmill according to another embodiment of the present disclosure.

In another embodiment, referring to FIG. 15, the electric treadmill further includes a torsional spring 80. One end of the torsional spring 80 is connected to the vertical tube 21, and the other end of the torsional spring 80 is connected to the front frame 11. The torsional spring 80 is stretched upon the vertical tube 21 rotating toward the front frame 11, so that the torsional spring 80 may apply a counter force to slow down a rotating speed.

Figure 14:
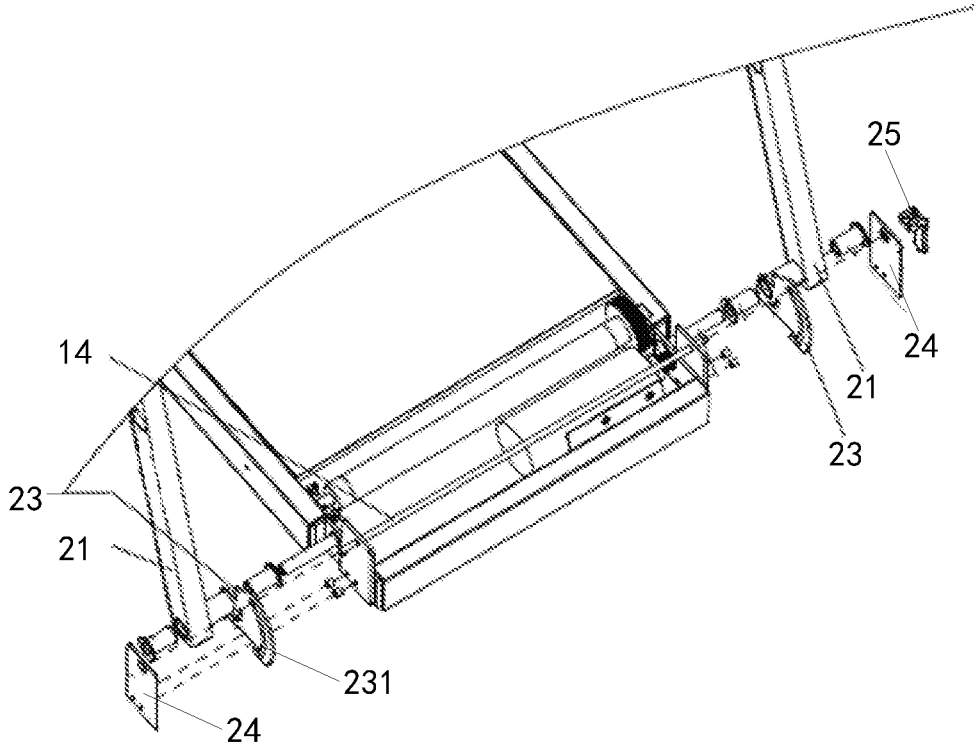
FIG. 14 is a schematic view of a partial structure of a treadmill according to another embodiment of the present disclosure.

Referring to FIG. 1 and FIG. 14, in an embodiment, an angle retaining plate 23, a stopper plate 24 and a locking handle 25 are provided at a joint between the armrest 20 and the base 10. The angle retaining plate 23 is provided with a curved retaining slot 231. A retaining shaft 14 corresponding to the curved retaining slot 231 is provided at the base 10. The retaining shaft 14 and the angle retaining plate 23 cooperate to limit a rotating angle of the armrest 20. One end of the locking handle 25 is provided with a cam structure so that the locking handle 25 may limit a rotation of the armrest 20 relative to the base 10. When being folded for storage, the armrest 20 may be folded over the base 10 by pulling the locking handle 25 and rotating the armrest 20, and it is very easy and convenient to operate.

As shown in FIG. 1, in an embodiment, an angle between the front frame 11 and the rear frame 12 varies between 0 and 180 degrees. The tread board 13 comprises a front tread board 131 and a rear tread board 132. The front tread board 131 is provided in the front frame 11, and the rear tread board 132 is provided in the rear frame 12. When the angle between the front frame 11 and the rear frame 12 is 180 degrees, the front tread board 131 and the rear tread board 132 are combined to support the user. When the angle between the front frame 11 and the rear frame 12 is 0 degree, the front tread board 131 and the rear tread board 132 are folded for storage.

Further as shown in FIG. 1 to FIG. 3, the armrest 20 includes a plurality of vertical tubes 21 disposed on two sides of the front frame 11 respectively. The vertical tube 21 is connected with the cross tube 22 to form a storage space 60 for accommodating the base 10. When the angle between the front frame 11 and the rear frame 12 is 0 degree, the front frame 11 and the rear frame 12 may be accommodated in the storage space 60.

It should be noted that words such as "front", "rear", "upper", "lower" and the like described herein are all for convenience of description, and do not necessarily correspond to the front and rear of the space in actual work.

Other configurations of the electric treadmill of the present embodiments can employ various technical solutions that are known to those skilled in the art at present and in the future, which will not be described in detail herein.

In the description of the present specification, the description referring to the terms "one embodiment", "some embodiments", "an example", "a specific example", or "some examples" and the like means particular features, structures, materials, or characteristics in combination with the embodiment or example are included in at least one embodiment or example of present disclosure described. Furthermore, the specific features, structures, materials, or characteristics described can be combined in any suitable manner in any one or more of the embodiments or examples. Additionally, different embodiments or examples described in this specification and features of different embodiments or examples can be incorporated and combined by those skilled in the art without mutual contradiction.

Additionally, the terms "first" and "second" are used for descriptive purposes only and are not to be construed as indicating or implying relative importance or implicitly indicating the number of indicated technical features. Thus, features defining "first" and "second" may explicitly or implicitly include at least one of the features. In the description of the present disclosure, "a plurality of" means two or more, unless expressly limited otherwise.

The foregoing descriptions are merely specific embodiments of the present disclosure, but not intended to limit the protection scope of the present disclosure. Those skilled in the art may easily conceive of various changes or modifications within the technical scope disclosed herein, all these should be covered within the protection scope of the present disclosure. Therefore, the protection scope of the present disclosure should be subject to the protection scope of the claims.

What is claimed is:

1. An electric treadmill, comprising:

a base comprising a front frame, a rear frame and a connecting assembly, wherein tread boards are provided within the front frame and the rear frame, and the front frame and the rear frame are hinged together by the connecting assembly to enable the base to be folded; and an armrest comprising a vertical tube and a cross tube, wherein one end of the vertical tube is connected to the cross tube, and an other end of the vertical tube is rotatably coupled to the base to fold the armrest with respect to the base, wherein the vertical tube comprises an armrest tube, a side rest is detachably connected with the armrest tube, and a connecting portion is provided on the armrest tube, corresponding to the side rest;

wherein the side rest comprises a main body, a spring is provided at an end of the main body, and a ball connected to the spring; and the ball is abutted against a connecting portion by a force of the spring;

wherein the vertical tube further comprises a hollow tube, and a controllable gas spring, wherein the armrest tube is disposed in the hollow tube, one end of the controllable gas spring is connected to the armrest tube, and an other end of the controllable gas spring is connected to the hollow tube, and the armrest tube is telescoped relative to the hollow tube to adjust a length of the armrest; and wherein a tab is further provided at the end of the main body; a slot is provided on the connecting portion; and the tab is inserted into the slot to connect the main body to the connecting portion.

2. The electric treadmill of claim 1, wherein the connecting assembly comprises a first connecting member, a second connecting member, two third connecting members, and a fourth connecting member, wherein one end of the first connecting member is connected to the front frame and other end of the first connecting member is hinged with one end of each third connecting member; a middle portion of the second connecting member is hinged with a middle portion of each third connecting member; and one end of the fourth connecting member is hinged with one end of the second connecting member and other end of the fourth connecting member is connected to the rear frame.

3. The electric treadmill of claim 2, wherein the first connecting member comprises a head portion and a bottom portion; the head portion protrudes from an intermediate position of the bottom portion to form a T shaped first connecting member; a first through hole is provided at one end of the bottom portion away from the head portion, to hinge the first connecting member with the base; a second through hole is provided at the head portion to hinge the first connecting member with each third connecting member, and a side of the bottom portion facing the second connecting member is provided with a first curved slot;

wherein the second connecting member comprises a front portion; and a rear portion disposed at a predetermined angle with the front portion, one end of the front portion away from the rear portion is provided with a first curved surface corresponding to the first curved slot, and one end of the rear portion away from the front portion is hinged with the one end of the fourth connecting member;

wherein the one end of each third connecting member is hinged with the head portion, other end of each third connecting member is provided with an arcuate protrusion facing the fourth connecting member; and wherein the one end of the fourth connecting member is hinged with the rear portion, the other end of the fourth connecting member is hinged with the rear frame, and the fourth connecting member further is provided with a second curved surface facing the third connecting members, and the second curved surface is fitted to the arcuate protrusion.

4. The electric treadmill of claim 1, wherein the connecting assembly comprises a front mount, a rear mount, a first hinge tooth, a second hinge tooth, a third hinge tooth and a fourth hinge tooth; the first hinge tooth, the second hinge tooth, the third hinge tooth, and the fourth hinge tooth are all L-shaped with a short portion and a long portion; the front mount is fastened to the front frame and the rear mount is fastened to the rear frame; a joint between the short portion and the long portion of the first hinge tooth, a joint between the short portion and the long portion of the second hinge tooth, a joint between the short portion and the long portion of the third hinge tooth, and a joint between the short portion and the long portion of the fourth hinge tooth are hinged together by a first rotating shaft; front ends of the long portions of the first hinge tooth and the second hinge tooth are hinged together by a second rotating shaft; rear ends of the long portions of the third hinge tooth and the fourth hinge tooth are hinged together by a third rotating shaft; the third hinge tooth is disposed between the first hinge tooth and the second hinge tooth, and the second hinge tooth is disposed between the third hinge tooth and the fourth hinge tooth; and wherein the front mount is provided with a front relief groove for accommodating the first hinge tooth and the second hinge tooth, and a front chute extending in a front-rear direction; the rear mount is provided with a rear relief groove for accommodating the third hinge tooth and the fourth hinge tooth, and a rear chute extending in the front-rear direction; the second rotating shaft is slidably coupled to the front chute, and the third rotating shaft is slidably coupled to the rear chute.

5. The electric treadmill of claim 1, further comprising a locking assembly, wherein the locking assembly comprises a quick release lever, a pressing block, a positioning sleeve, a spring, and a spacer; the positioning sleeve is disposed at a joint between the hollow tube and the armrest tube; the quick release lever is hinged with the positioning sleeve, and the pressing block is disposed between the quick release lever and the positioning sleeve; and one end of the quick release lever connected to the positioning sleeve is provided with a cam structure so as to press the quick release lever against the pressing block to lock the armrest tube.

6. The electric treadmill of claim 1, further comprising a depressurizing lever, wherein one end of the depressurizing lever is connected to the armrest, and an other end of the depressurizing lever is connected to the base to slow down a speed of the armrest rotating toward the base.

7. The electric treadmill of claim 6, wherein the one end of the depressurizing lever is connected to the hollow tube of the vertical tube, and the other end of the depressurizing lever is connected to the front frame, both ends of which are fastened by bolts and fasteners.

8. The electric treadmill of claim 1, further comprising a torsional spring, wherein one end of the torsional spring is connected to the vertical tube, and other end of the torsional spring is connected to the front frame, to slow down a rotating speed of the vertical tube toward the front frame.

9. The electric treadmill of claim 1, wherein an angle retaining plate, a stopper plate and a locking handle are provided at a joint between the vertical tube and the base, the angle retaining plate is provided with a curved retaining slot, and a retaining shaft corresponding to the curved retaining slot is provided at the base to cooperate with the angle retaining plate, so as to limit a rotating angle of the armrest, and wherein one end of the locking handle is provided with a cam structure so that the locking handle enables to limit a rotation of the vertical tube relative to the base, and the armrest is foldable over the base by pulling the locking handle and rotating the armrest for storage.

10. The electric treadmill of claim 1, wherein an angle between the front frame and the rear frame varies between 0 and 180 degrees, the tread boards comprise a front tread board and a rear tread board, the front tread board is provided in the front frame and the rear tread board is provided in the rear frame; and the front tread board and the rear tread board are combined to support an user in case of the angle between the front frame and the rear frame being 180 degrees.

11. The electric treadmill of claim 10, wherein the armrest comprises a plurality of vertical tubes disposed on two sides of the front frame respectively, the vertical tubes are connected with the cross tube to form a storage space for accommodating the base, and the front frame and the rear frame are accommodated in the storage space in case of the angle between the front frame and the rear frame being 0 degree.

* * * * *